United States Patent [19]

Kurosaki

[11] Patent Number: 4,469,004

[45] Date of Patent: Sep. 4, 1984

[54] BASS DRUM USED FOR TRAINING PURPOSES

[75] Inventor: Makoto Kurosaki, Shizuoka, Japan

[73] Assignee: Nippon Gakki Seizo Kabushiki Kaisha, Japan

[21] Appl. No.: 377,450

[22] Filed: May 12, 1982

[30] Foreign Application Priority Data

May 12, 1981 [JP] Japan ..... 56-70196
Nov. 27, 1981 [JP] Japan ..... 56-175468

[51] Int. Cl.[3] ..... G10D 13/02
[52] U.S. Cl. ..... 84/411 P
[58] Field of Search ..... 84/411–414

[56] References Cited

U.S. PATENT DOCUMENTS 2,563,346 8/1951 Livingston ..... 84/412
3,597,520 8/1971 Andrews ..... 84/411 P
4,102,235 7/1978 Le Masters ..... 84/411 P

FOREIGN PATENT DOCUMENTS 604891 5/1960 Italy ..... 84/411
628721 11/1961 Italy ..... 84/412

*Primary Examiner*—Donald A. Griffin
*Attorney, Agent, or Firm*—Lerner, David, Littenberg, Krumholz & Mentlik

[57] ABSTRACT

A training bass drum has a length significantly larger than those of conventional training bass drum so that it generates musical tones with sufficient noise control but attains ample bass range effect. The resultant elongated internal space is advantageously utilized for encasing other sorts of percussive musical instruments such as snare drums and tomtoms.

5 Claims, 7 Drawing Figures

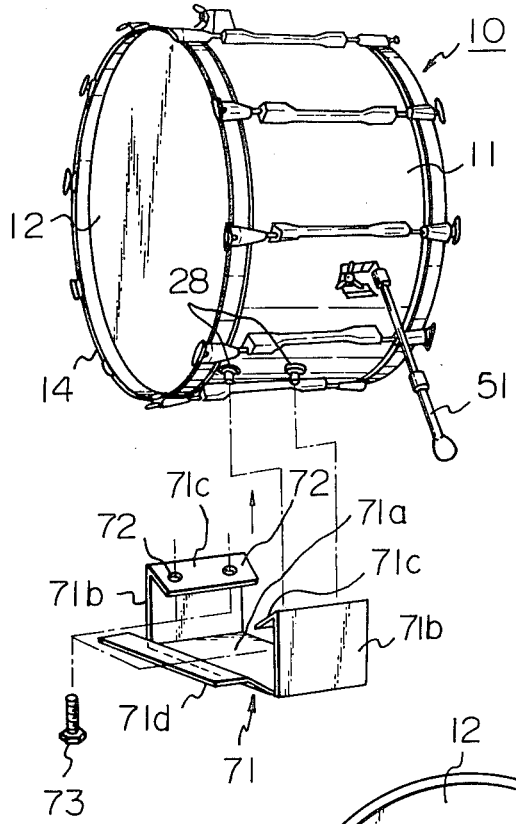
Fig. 5
Fig. 6
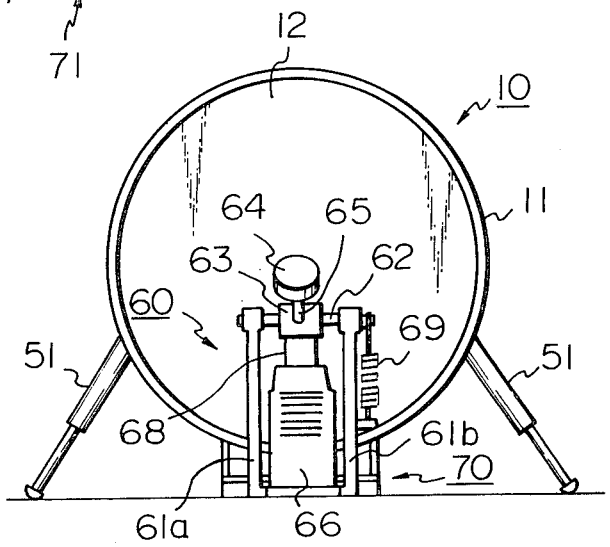

BASS DRUM USED FOR TRAINING PURPOSES

The present invention relates to an improved bass drum used for training purposes, and more particularly relates to an improved training bass drum which enables generation of beautifully adjusted musical tones very close to those by real bass drums, and provides a compact storage for other sorts of drums used as component parts of a drum set.

A training drum set includes a training bass drum and its accessories for keeping the drum in position during performance, and the bass drum is comprised of a cylindrical body of a relatively small axial length and a drum head coupled to one longitudinal end of the body.

The short longitudinal size of the bass drum on the one hand assures generation of musical tones of small tone volume, thereby well avoiding noise problem to be otherwise caused by training performance. A training bass drum of such a short construction on the other hand cannot generate musical tones with sufficient bass range effect which is obtained with bass drums for real performance. For ideal training of music players, it has been strongly demanded in the field that a training bass drum is able to generate musical tones of small tone volume with sufficient bass range effect which is usually obtained with bass drums for real performance.

It is one object of the present invention to duly respond to such a requirement. In order to attain this object, the training bass drum in accordance with the first aspect of the present invention includes a cylindrical body of a relatively long construction with a reduced diameter.

For performance or training, a bass drum is arranged in position with other drums such as snare drums and tomtoms by means of proper support stands. These drums have to be dismounted from the associated support stands for storage and transportation, respectively, and a lot of different cases have to be used for different drums and support stands. This connects to need for a large space for their storage and transportation.

It is another object of the present invention to provide a compact construction for storage and transportation of percussive musical instruments.

According to another aspect of the present invention which is closely related to the above-described first aspect, the elongated bass drum is constructed so as to be able to internally accommodate other percussive musical instruments for storage and transportation purposes.

A bass drum is usually used in combination with a step-in type foot beater assembly whose beater beats the drum head when an associated foot board is stepped on by a player. More specifically, the training drum is nearly horizontally kept in position on the floor by assistance of support stands, and the beater assembly is arranged near the drum with its beater actuable on the drum head. For generation of beauticul musical tones, the combination should be adjusted so that the beater should beat about the center section of the drum head.

According to the first aspect of the present invention, the diameter of the bass drum has to be reduced for restraint of tonal volume. When a bass drum of such a reduced diameter is used in conbination with an ordinary type foot beater assembly, the beater will beat the section of the drum head above its center, and such off-center beating naturally deteriorates musical tones to be generated.

It is a further object of the present invention to successfully obviate such off-center beating trouble despite reduction in drum diameter for noise problem elimination. In accordance with the third aspect of the present invention, the training drum set includes an auxiliary support mechanism for the drum which supports the drum above the floor.

BRIEF DESCRIPTION OF THE DRAWINGS

FIGS. 5 and 6 are perspective and end views of another embodiment of the training drum assembly in accordance with the present invention used in combination with an ordinary foot beater assembly.

DESCRIPTION OF PREFERRED EMBODIMENTS

For conveniency in explanation, the following description will be focussed upon application of the present invention to a training drum set.

Figure 1:
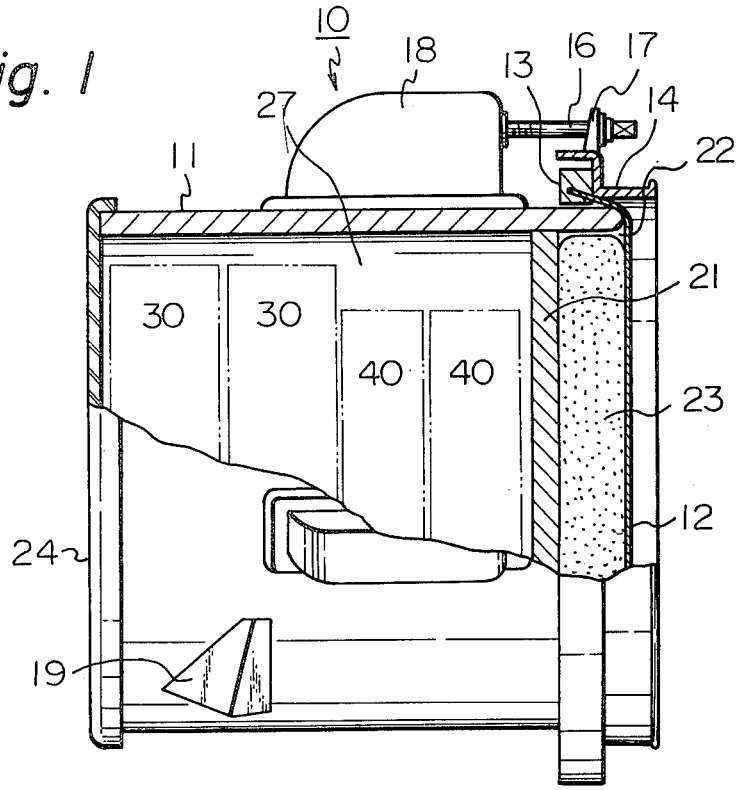
FIG. 1 is a side view, partly in section, of one embodiment of a bass drum advantageously used for the training drum set in accordance with the present invention.

One embodiment of the bass drum advantageously used for the training drum set in accordance with the present invention is shown in FIG. 1. The training bass drum 10 includes an elongated cylindrical body 11 which is laid directly on the floor with its longitudinal axis almost parallel to the floor surface. The axial length of the cylindrical body 11 is significantly larger than that of conventional training bass drums, and its diameter is smaller than that of the conventional real bass drums. In one actual example, the cylindrical body 11 is 14 inches in axial length and 16 inches in diameter.

One open end of the cylindrical body 11 is closed by a drum head 12 which is made of natural leather or synthetic resin. The peripheral edge of the drum head 12 is secured to a head ring 13 tightly inserted over the end section of the cylindrical body 11 in a known manner. A fastener ring 14 is also tightly inserted over the end section of the cylindrical body 11 and a number of fastener bolts 16 are attached to the periphery of the fastener ring 14 by means of brackets 17. The threaded ends of the fastener bolts 16 are in screw engagement with associated lugs 18 secured to the outer surface of the cylindrical body 11. By turning the fastener bolts 16, the fastener ring 14 is tightly mounted to the cylindrical body 11 in order to stretch the drum head 12 under uniform tension via the head ring 13. A pair of leg seats 19 are arranged on the outer surface of the cylindrical body 11.

At a position somewhat inside of the drum head 12, an end closer 21 is secured to the inner surface of the cylindrical body 11 in order to define a space 22 in which a flat muffler pad 23 is inserted in contact with the inner surface of the drum head 12. The muffler pad 23 is preferably made of a soft elastic material such as urethane, sponge, felt and foamed styrol. When requirement for noise restraint is too high, the other end of the cylindrical body 11 may advantageously be closed by a detachable lid 24 which is preferably made of a particle board.

Figure 2:
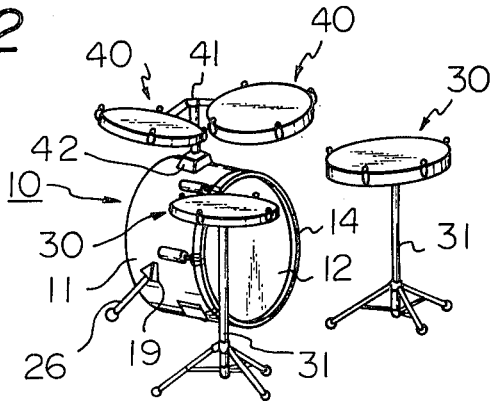
FIG. 2 is a perspective view of one embodiment of the training drum set in accordance with the present invention.

One example of use of the training bass drum in accordance with the present invention in combination with other types of drums is illustrated in FIG. 2. In the arrangement, the training drum set includes the training bass drum 10 held in position on the floor by a pair of legs 26 coupled to the leg seat 19, training snare drums 30 carried by tripoid support stands 31, and a pair of training tomtoms 40 carried by a holder 41 which is secured to the outer surface of the cylindrical body 11 of the training bass drum 10 by means of a bracket 42.

When the other end of the cylindrical body 11 of the training bass drum 10 is closed by the detachable lid 24, a space 27 is left inside the training bass drum 10. In accordance with the second aspect of the present invention, this inside space 27 is advantageously used for accommodating other drums or percussive musical instruments for conveniency in storage and transportation. In this case, it is required that the inner diameter of the cylindrical body 11 should be large enough to smoothly accommodate in the space 27 the percussive musical instruments usually used for performance in combination with the training bass drum. In the case of the illustrated example, a pair of training snare drums 30 and a pair of training tomtoms 40 are accommodated in the space 27 as shown with chain lines. Depending on the situation, the space 27 may be used for reserving percussive musical instruments used for real performance.

Thus, the training drum set in accordance with the present invention enables effective utilization of the dead space within the training bass drum as a reservoir for other percussive musical instruments for utmost conveniency in storage and transportation.

Figure 3A:
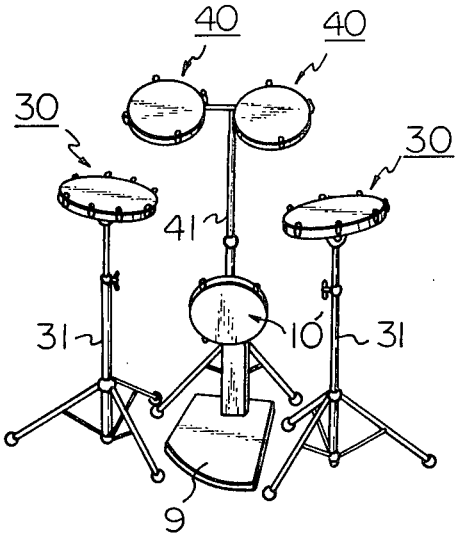
Fig. 3A PRIOR ART
FIGS. 3A and 3B are perspective views of conventional training drum set.
Figure 3B:
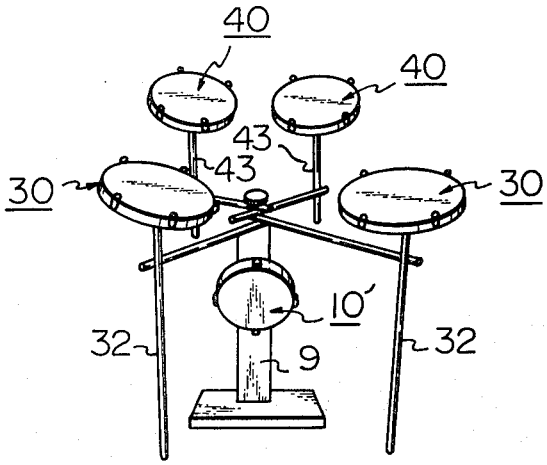
Fig. 3B PRIOR ART

One conventional arrangement of percussive musical instruments is shown in FIG. 3A, in which a training bass drum 10' is mounted to a pedestal 9, training snare drums 30 are held by associated tripoid support stands 31, and a pair of tomtoms 40 are carried by tripoid holders 41. The other arrangement of percussive musical instruments is illustrated in FIG. 3B, in which a training bass drum 10' is mounted to a pedestal 9, training snare drums 30 are held by legs 32 mounted to the pedestal 9, and training tomtoms 40 carried by legs 43 also mounted to the pedestal 9.

For performance, the drum head 12 of the training bass drum 10 is beaten by a beater of a foot beater assembly which is operated by a foot of the player.

Figure 4:
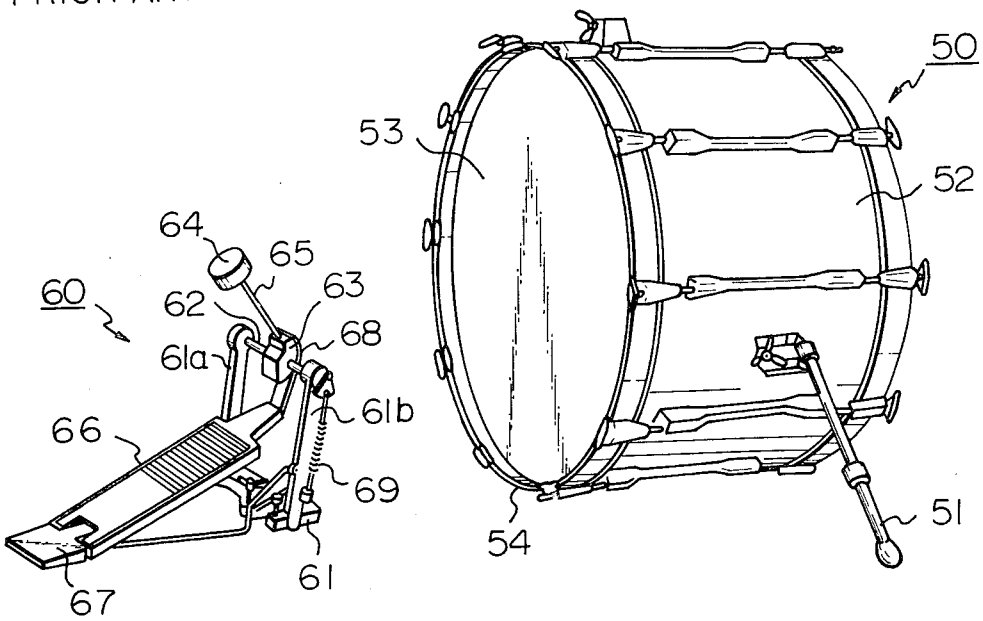
Fig. 4 PRIOR ART
FIG. 4 is a perspective view of a conventional real bass drum used in combination with a foot beater assembly.

One exmple of the conventional real bass drum assembly used in combination with such a foot beater assembly is illustrated in FIG. 4, in which a real bass drum 50 is placed in position directly on the floor by a pair of legs 51 attached to its cylindrical body 52. The foot beater assembly 60 is arranged facing one end of the cylindrical body 52 which is closed by a drum head 53 by means of a fastener ring 54.

More specifically, the foot beater assembly 60 includes a pair of upright stands **61*a* and 61*b* which rotatably support a horizontal shaft 62. A rocker 63 is secured to the shaft 62 and carries a beater 64 by means of a beater rod 65. The lower end of an inclined foot board 66 is pivoted to a pedestal 67 whereas the upper end thereof is coupled to the back of the rocker 63 by means of a timing belt 68. Springs 69 are attached to the stands 61*a* and 61*b* in order to keep the beater 64 at its stand-by position shown in FIG. 4**.

In use, the foot beater assembly 60 is coupled to the fastener ring 54 of the bass drum 50. As the foot board 66 is stepped by the player during performance, the beater 64 is driven for swing motion about the axis of the shaft 62 against the force of the springs 69 in order to beat the drum head 53 of the bass drum 50.

According to the first and second aspects of the present invention, the diameter of the cylindrical body 11 of the training bass drum 10 is designed smaller than that of conventional real bass drums and reduced to an extent which allows accommodation of other percussive musical instruments usually used in combination with the training bass drum. As a consequence, when the training bass drum in accordance with the present invention is placed on the floor as in the case of FIG. 4, the center of its drum head 12 is located lower than that of the real bass drum 50, and the beater 64 of the foot beater assembly 60 may beat a point on the drum head 12 above its center. Such off-center beating naturally deteriorates musical tones to be generated.

In order to avoid such an off-center beating trouble, the training bass drum in accordance with the third aspect of the present invention further includes an auxiliary support mechanism shown in FIGS. 5 and 6. The auxiliary support mechanism 70 includes a channel-shaped support block 71 made up of a horizontal center section **71*a*, a pair of parallel side walls 71*b* extending upwards from both ends of the center section 71*a*, and inclined drum seats 71*c* formed by bending the top edges of the side walls 71*b* inwards. A flap 71*d* is formed on one end of the center section 71*a* for connection with the foot beater assembly 60. The drum seats 71*c* are provided with apertures 72 for engagement with fastener nuts 28 arranged on the outer surface of the cylindrical body 11 of the training bass drum 10. Fastener bolts 73 are used for engagement with the fastener nuts 28 via the apertures 72 in the support block 71**.

In use, the training bass drum 10 is placed on the drum seats **71*c* of the support block 71 so that the fastener nuts 28 meet the apertures 72 and both are combined tightly by means of the fastener bolts 73, and the foot beater assembly 60 is connected to the flap 71*d* of the support block 71**.

Thanks to use of the above-described auxiliary support mechanism, the training bass drum 10 is now kept at a raised position over the floor so that the beater 64 should beat right in the center of the drum head 12. By use of such an auxiliary support mechanism, the training bass drum 10 in accordance with the present invention can be used in combination with ordinary foot beater assembly without causing any off-center beating troubles.

The channel-shaped support block in accordance with the present invention may be made of metal, wood and synthetic resin. It is also advisable to attach vibration absorbers to the bottom face of the center section **71*a* and/or the top faces of the drum seats 71*c*** in order to avoid generation of harsh noises. Further, the support block may be permanently secured to the training bass drum. The shape of the support block may be modified as long as it has a top seat or seats for the training bass drum and a connection for the foot beater assembly.

I claim:

1. An improved bass drum used for training purposes comprising a long, hollow cylindrical body of a relatively small diameter, a drum head coupled to one longitudinal end of said cylindrical body, a flat, transverse end closer secured to the inner surface of said cylindrical body at a position near said one longitudinal end leaving an elongated cylindrical space on the side opposite to said drum head, and a sound absorbing pad placed in a short space between said end closure and said drum head in surface contact with the inside surface of said drum head.

2. An improved bass drum as claimed in claim 1 in which said bass drum further includes a detachable lid coupled to the other longitudinal end of said cylindrical body.

3. An improved bass drum set as claimed in claim 2 in which the diameter of said cylindrical body is large enough to accommodate, in said elongated cylindrical between said end closer and detachable lid, at least one percussive musical instrument to be used in combination with said bass drum.

4. An improved bass drum used for training purposes comprising a long, hollow cylindrical body of a relatively small diameter, a drum head coupled to one longitudinal end of said cylindrical body, a flat, transverse end closer secured to the inner surface of said cylindrical body at a position near said one longitudinal end leaving an elongated cylindrical space on the side opposite to said drum head, a sound absorbing pad placed in a short space between said end closer and said drum head in surface contact with the inside surface of said drum head, and an auxiliary support mechanism including a support block provided atop with a seat on which said cylindrical body is mounted, means for securing said support block to said cylindrical body and means for connecting said support block to a foot beater assembly, said support block having a channel-shaped construction which includes a flat center section, a pair of side walls extending upwards from both ends of said center section, and a pair of drum seats formed by inwardly bent top sections of said side walls.

5. An improved bass drum as claimed in claim 4 in which

At least one of the bottom face of said support block and top face of said seat is covered with a vibration absorbable material.

* * * * *